US007107906B2

(12) United States Patent
Becker et al.

(10) Patent No.: US 7,107,906 B2
(45) Date of Patent: Sep. 19, 2006

(54) DEVICE FOR FEEDING OR REMOVING A PRINTING PLATE INCLUDING A PIVOTAL PLATE STORAGE DEVICE HAVING A LINEARLY MOVABLE PLATE SUPPORT

(75) Inventors: Willi Becker, Bammental (DE); Farhad Haddadian, Heidelberg (DE); Stefan Mutschall, Östringen (DE); Ivo Richter, Heidelberg (DE); Steffen Siegemund, Walldorf (DE); Joachim Zarges, Mannheim/Friedrichsfeld (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 2 days.

(21) Appl. No.: 10/899,765

(22) Filed: Jul. 26, 2004

(65) Prior Publication Data

US 2005/0016403 A1 Jan. 27, 2005

(30) Foreign Application Priority Data

Jul. 25, 2003 (DE) ..... 103 33 920

(51) Int. Cl.
*B41F 27/06* (2006.01)
*B41L 31/00* (2006.01)

(52) U.S. Cl. ..... 101/477; 101/415.1

(58) Field of Classification Search ..... 101/477, 101/415.1, 378, DIG. 36
See application file for complete search history.

(56) References Cited

U.S. PATENT DOCUMENTS 3,178,197 A * 4/1965 Boatner ..... 280/37
3,999,239 A * 12/1976 Misuna ..... 15/88
5,127,328 A 7/1992 Wieland ..... 101/415.1
5,167,187 A * 12/1992 Dettinger et al. ..... 101/218
5,289,775 A * 3/1994 Spiegel et al. ..... 101/477
5,406,888 A * 4/1995 Sugiyama et al. ..... 101/415.1
5,460,092 A 10/1995 Beisel et al. ..... 101/477
5,479,858 A 1/1996 Beisel et al. ..... 101/477
5,495,805 A * 3/1996 Beisel et al. ..... 101/477
5,511,478 A * 4/1996 Lindner et al. ..... 101/477
5,595,119 A 1/1997 Hada et al. ..... 101/477
6,142,072 A 11/2000 Rudewitz et al. ..... 101/216

FOREIGN PATENT DOCUMENTS

| | | |
|---|---|---|
| DE | 39 40 795 C2 | 6/1991 |
| DE | 41 40 413 C2 | 6/1993 |
| DE | 42 14 049 C2 | 11/1993 |
| DE | 195 08 846 A1 | 9/1996 |
| DE | 198 03 726 A1 | 8/1999 |
| EP | 0 710 554 A2 | 5/1996 |
| EP | 1 155 840 A2 | 11/2001 |
| JP | 3-187749 | 8/1991 |

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A device for feeding a plate to and/or removing a plate from a printing press includes a plate storage device for holding a new and/or used plate. The plate storage device has a linearly movable plate support. The plate is particularly a printing plate.

9 Claims, 7 Drawing Sheets

DEVICE FOR FEEDING OR REMOVING A PRINTING PLATE INCLUDING A PIVOTAL PLATE STORAGE DEVICE HAVING A LINEARLY MOVABLE PLATE SUPPORT

BACKGROUND OF THE INVENTION

Field of the Invention

The invention relates to a device for feeding a printing plate to and/or removing the printing plate from, a printing press. More particularly, the invention relates to a printing plate feeder or feeding device for a plate cylinder of a sheet-fed rotary printing press.

Printing plate feeding devices of that general type are usually disposed outside the printing tower frame and have a storage device for holding the printing plate. In that regard, the storage device extends upwardly to such an extent that access to the inking and dampening unit rollers disposed above the plate cylinder is blocked or at least impeded.

German Patent DE 39 40 795 C2, corresponding to U.S. Pat. No. 5,127,328 and Japanese Patent 3-187749, discloses a printing plate feeding device wherein an upper part of the storage device is downwardly foldable by a hinge or hinge joint.

German Patent DE 42 14 049 C2, corresponding to U.S. Pat. Nos. 5,479,858 and 5,460,092, discloses a printing plate feeding device which has such a short structure that access to inking and dampening solution rollers is not blocked at all. In that regard, however, a problem arises in that the end of the printing plate projects so far from the storage device that, when the printing plate feeding device is angled in, the end of the printing plate may bend over and strike the adjacent printing unit tower. It is then impossible to rule out any scratching of the printing plate.

SUMMARY OF THE INVENTION

It is accordingly an object of the invention to provide a device for feeding and/or removing a printing plate, which overcomes the hereinafore-mentioned disadvantages of the heretofore-known devices of this general type and which does not impede access to the inking and dampening unit rollers.

With the foregoing and other objects in view, there is provided, in accordance with the invention, a device for feeding a plate to and/or removing a plate from a printing press. The device comprises a plate storage device for holding a new and/or used plate. The plate storage device has a linearly movable plate support.

In accordance with another feature of the invention, the plate is a printing plate.

In accordance with a further feature of the invention, the device includes a mechanism for moving the plate support out of and into the plate storage device.

In accordance with an added feature of the invention, the mechanism is a lazy tongs mechanism.

In accordance with an alternative feature of the invention, the mechanism is a rack mechanism.

In accordance with an additional feature of the invention, the rack mechanism includes a pinion driven by an actuating motor under sensor or switch control.

In accordance with yet another feature of the invention, the plate storage device is pivotally mounted. A mechanical deflection mechanism is provided which is pivotal by the plate storage device for effecting a linear movement of the plate support.

In accordance with yet a further feature of the invention, an operating cylinder is provided for linearly moving the plate support.

In accordance with yet an added feature of the invention, a solenoid valve is provided which is controllable by a sensor or switch for activating the operating cylinder.

In accordance with yet an additional feature of the invention, a rotatably mounted supporting roller is provided at a free end of the plate support.

In accordance with a concomitant feature of the invention, a spring-loaded latching and holding device is provided for locking the plate storage device in a plate feed position.

It is an advantage of the invention that the storage device for the printing plate can have such a short length that access to the inking unit disposed above the plate cylinder is not impeded. The storage device or chamber can thus be formed as part of the guard for the cylinders involved in the printing. The printing plate support according to the invention is disposed on the storage device or chamber so that it can be extended and retracted, and prevents the printing plate from bending over, in particular during the feeding of the printing plate.

In an advantageous embodiment, a mechanical extraction and insertion mechanism for the printing plate support is provided which, during a pivoting movement of the storage device from a guarding or protective position into the feed position, automatically extends the printing plate support. The extraction and insertion mechanism is particularly advantageously formed as lazy tongs, which effects an adequately large extension travel even with a small pivoting movement of the storage device.

In a second exemplary embodiment, a pneumatic insertion and extraction mechanism in the form of a pneumatically controlled operating cylinder is provided.

In a third exemplary embodiment, an electromotive extraction and insertion mechanism in the form of an electromotive rack drive is provided.

Other features which are considered as characteristic for the invention are set forth in the appended claims.

Although the invention is illustrated and described herein as embodied in a device for feeding and/or removing a printing plate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
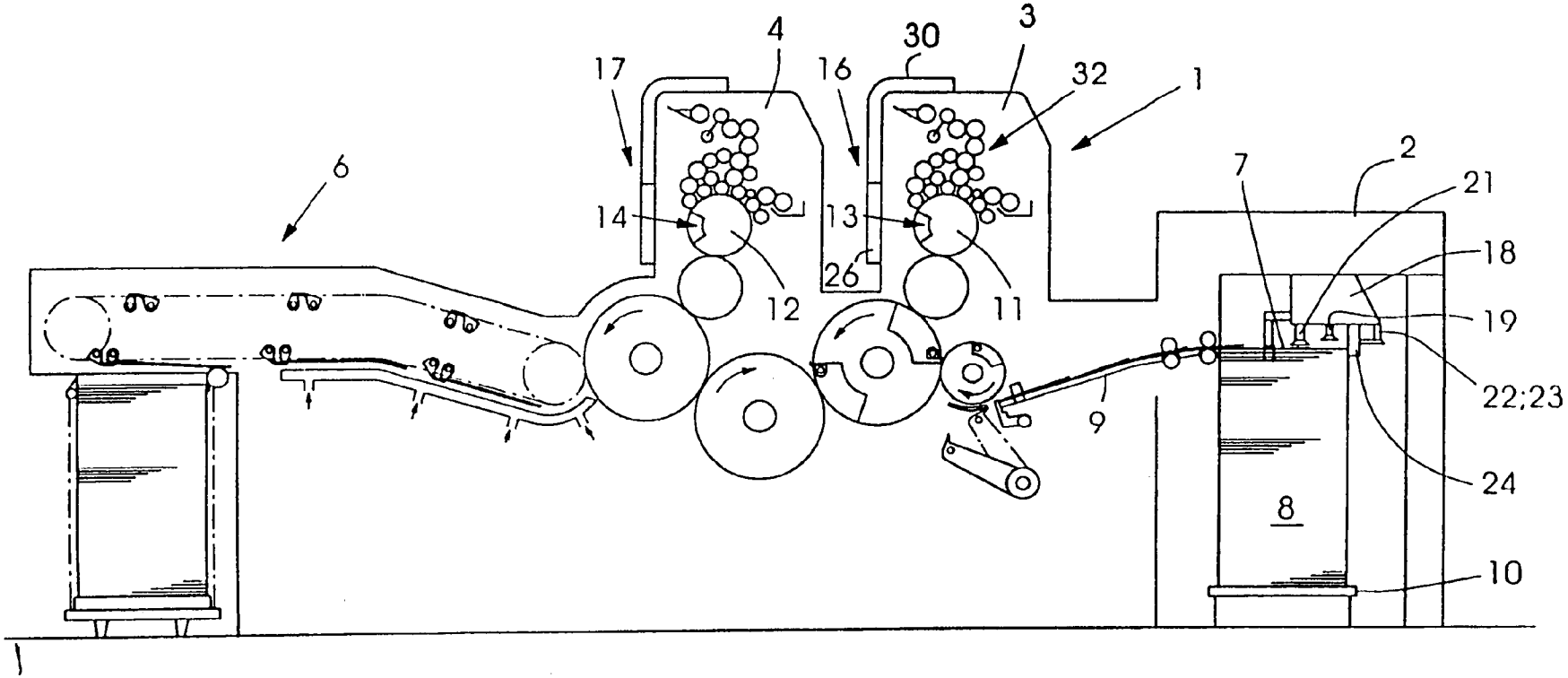
FIG. 1 is a diagrammatic, side-elevational view of a sheet-fed rotary printing press.

Referring now to the figures of the drawing in detail and first, particularly, to FIG. 1 thereof, there is seen a machine for processing sheets 7, for example a printing press 1, having a feeder 2, at least one printing unit (two printing units 3 and 4 being provided in this example), and a delivery or deliverer 6. The sheets 7 are removed from a sheet pile 8 and fed separately or imbricatedly, i.e., in an overlapped manner, over a feed table 9 to the printing units 3 and 4. Each of the printing units is provided with one respective plate cylinder 11, 12 in a conventional manner. Each of the respective plate cylinders 11 and 12 has a device 13, 14 for fastening or securing flexible printing plates thereon. Furthermore, each plate cylinder 11, 12 has a respective device 16, 17 assigned thereto for effecting a change of printing plates semi-automatically or fully automatically.

The sheet pile 8 rests on a controllably liftable pile board 10. Removal of the sheets 7 from the pile 8 thereof is carried out from the top of the sheet pile 8 by a so-called suction head 18 which has, in addition to other features, a number of lifting and dragging suckers 19 and 21 for singling or separating the sheets 7. Blowing or blast devices 22 for fanning or loosening the upper sheet layers, and sensing elements 23 for following-up or tracking the sheet pile 8, are also provided. Several lateral and rear stops 24 are provided in order to align the sheet pile 8, in particular the upper sheets 7 of the sheet pile 8.

Figure 2:
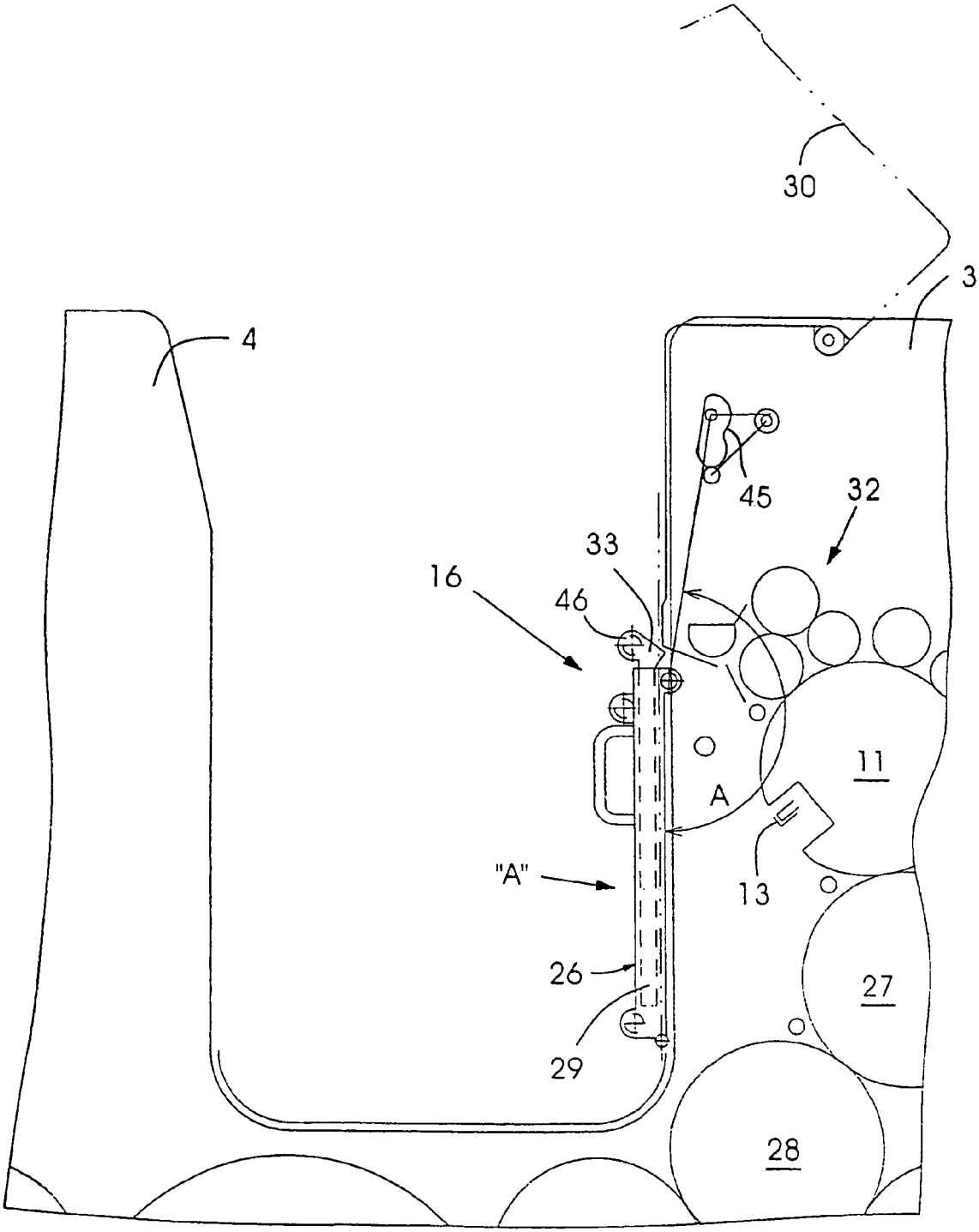
FIG. 2 is an enlarged, fragmentary, side-elevational view of FIG. 1, showing part of a printing unit tower having a printing plate storage device in a protecting or guard position.
Figure 3:
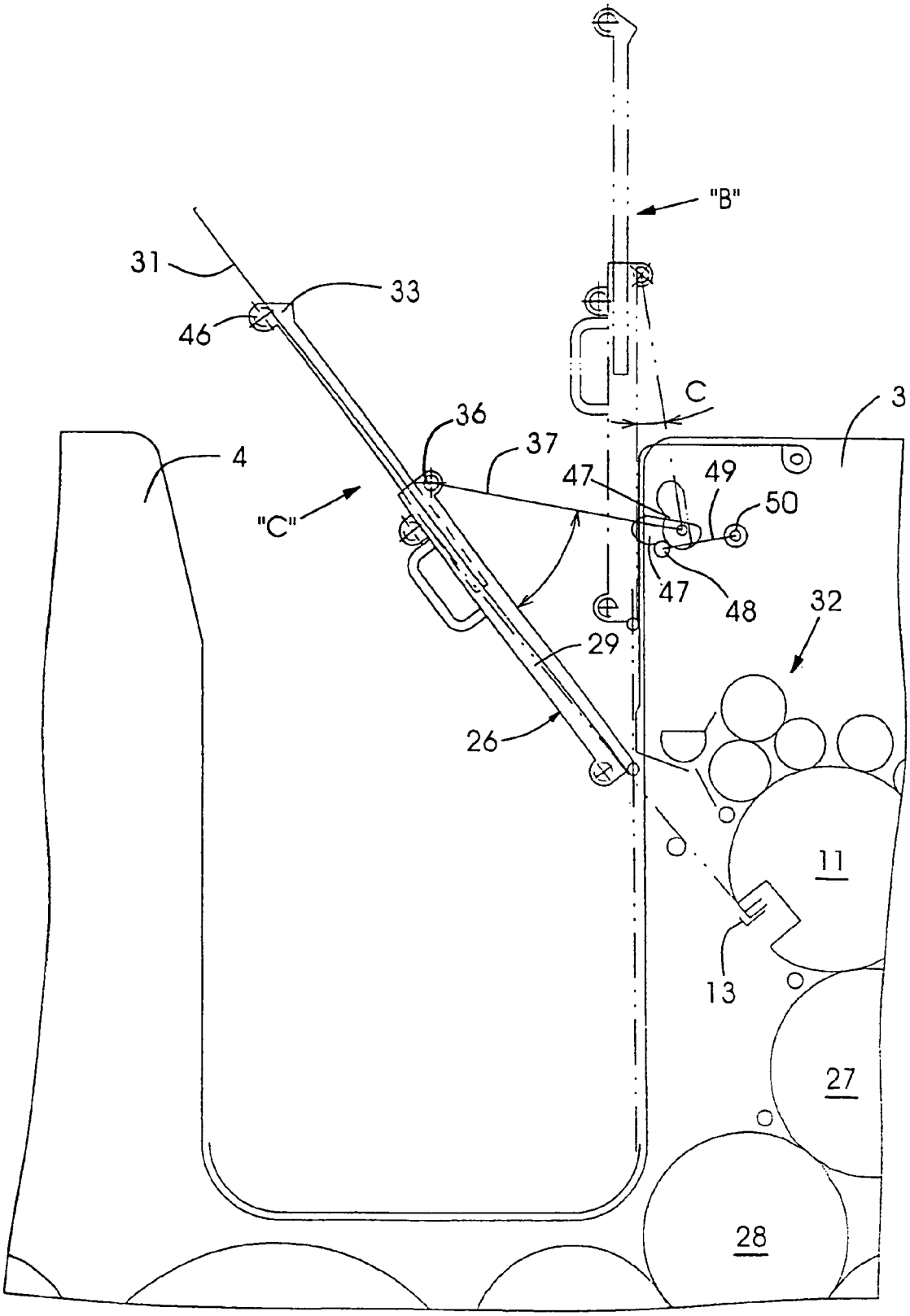
FIG. 3 is a view similar to that of FIG. 2, however, with the printing plate storage device of the printing unit tower in a printing plate feed position.

The invention of the instant application is described further herein with regard to the device 16 which, as shown, for example in FIG. 2, includes a combination of a lower guard 26 for the plate cylinder 11 and the blanket cylinder 27 or the impression cylinder 28 of the first printing unit 3, and a storage device or chamber 29 disposed in or on the guard 26 for holding a new or used printing plate 31 (see FIG. 3). The combined guard/storage device 26/29 is disposed in such a way as to be displaceable vertically from a lower "guard position" A into an upper "maintenance position" B shown in phantom in FIG. 3, and is pivotal into a "feed position" C shown in FIG. 3 for the purpose of feeding a respective printing plate 31. As is shown in FIG. 2, an upper guard 30 covers or shields access to an inking unit 32 and is likewise mounted so as to be pivotal for maintenance purposes. In dividing the overall guard system into the upper guard 30 and the lower guard 26, the printing plate storage device 29 is formed in such a way that the length thereof is shorter than the length of the printing plate 31 to be inserted therein which, for example, is kept ready to be fed to the plate cylinder 11. In order to support the end of the printing plate 31 projecting out of the printing plate storage device 29, provision is made for placing a longitudinally displaceable printing plate support 33 on the guard 26. The support 33 is disposed in such a way that it can either be pushed or slid out manually or by a suitable mechanism. The printing plate support 33 has a rotatably mounted supporting roller 46 located at a free end thereof.

Figure 4:
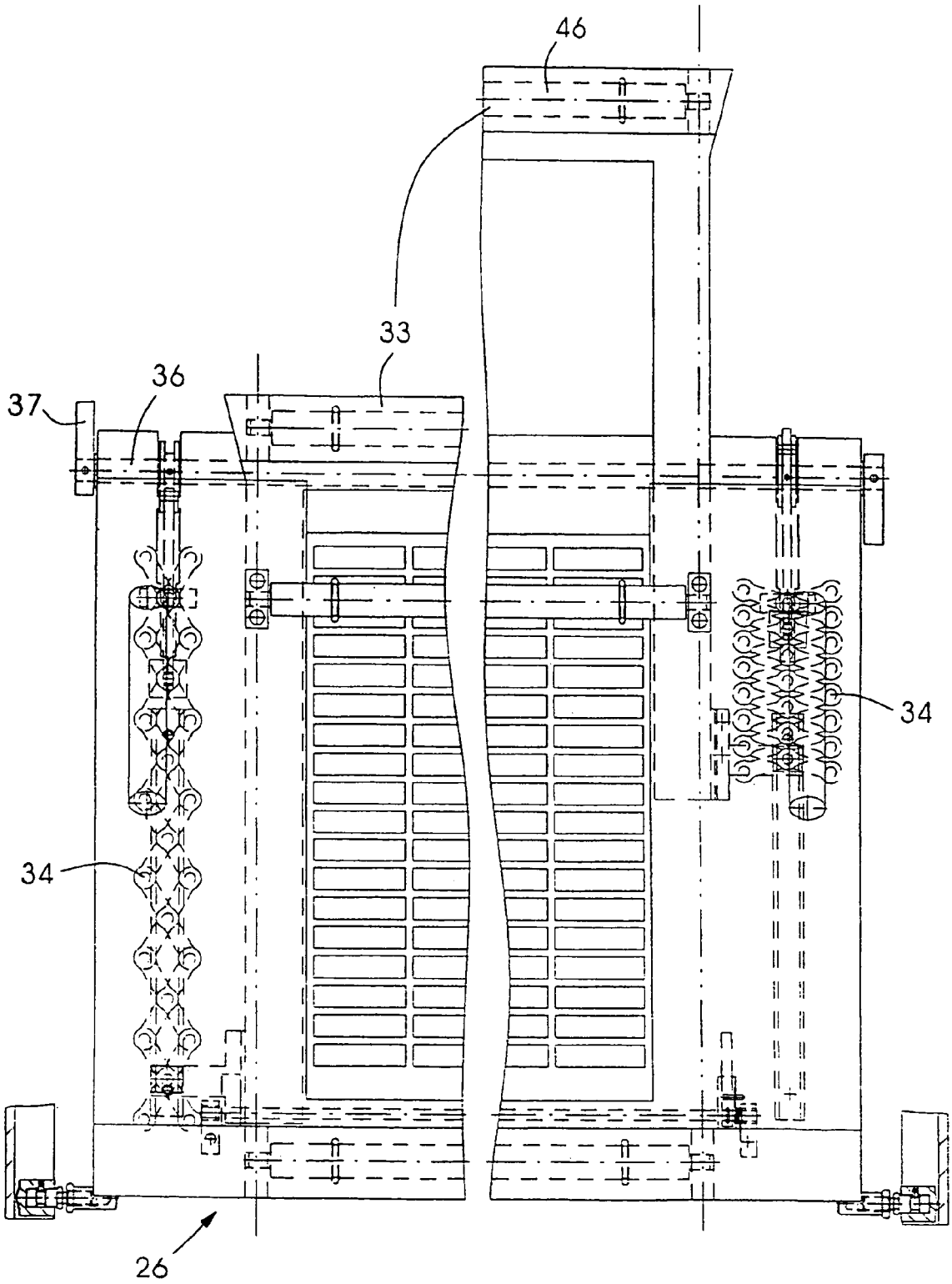
FIG. 4 is a plan view of the printing plate storage device with a mechanical insertion and extraction mechanism, shown in inserted condition in the left-hand half and in extended or extracted condition in the right-hand half of the figure.

In a first embodiment shown in FIG. 4, a so-called lazy tongs mechanism or transmission 34 is provided. The mechanism 34 automatically extends the printing plate support 33 due to a pivoting movement of the printing plate storage device 29 into the feed position C.

As is shown in FIG. 3, for example, a shaft 36 is pivotally mounted at the upper end of the storage device 29. The shaft 36 is connected to the printing unit or tower 3 by a pivoting lever 37. The pivoting lever 37 is disposed on both printing unit sides for the purpose of parallel force assistance and is pivotally mounted on the printing unit tower 3. The pivoting lever 37 bears a cam or a cam segment 47 which cooperates with a pressure roller 48. The pressure roller 48 is rotatably mounted at one end of a spring-loaded roller lever 49. The other end of the roller lever 49 is fixed to a plunger spring 50, which couples the two roller levers 37 with one another so that they ensure parallel force assistance for the storage device 29. The cam segment 47 is formed with a control valley or trough 45 for the pressure roller 48 and serves, in this position, to define a latching and holding position for the storage device 29 in the plate feed position C.

Figure 5:
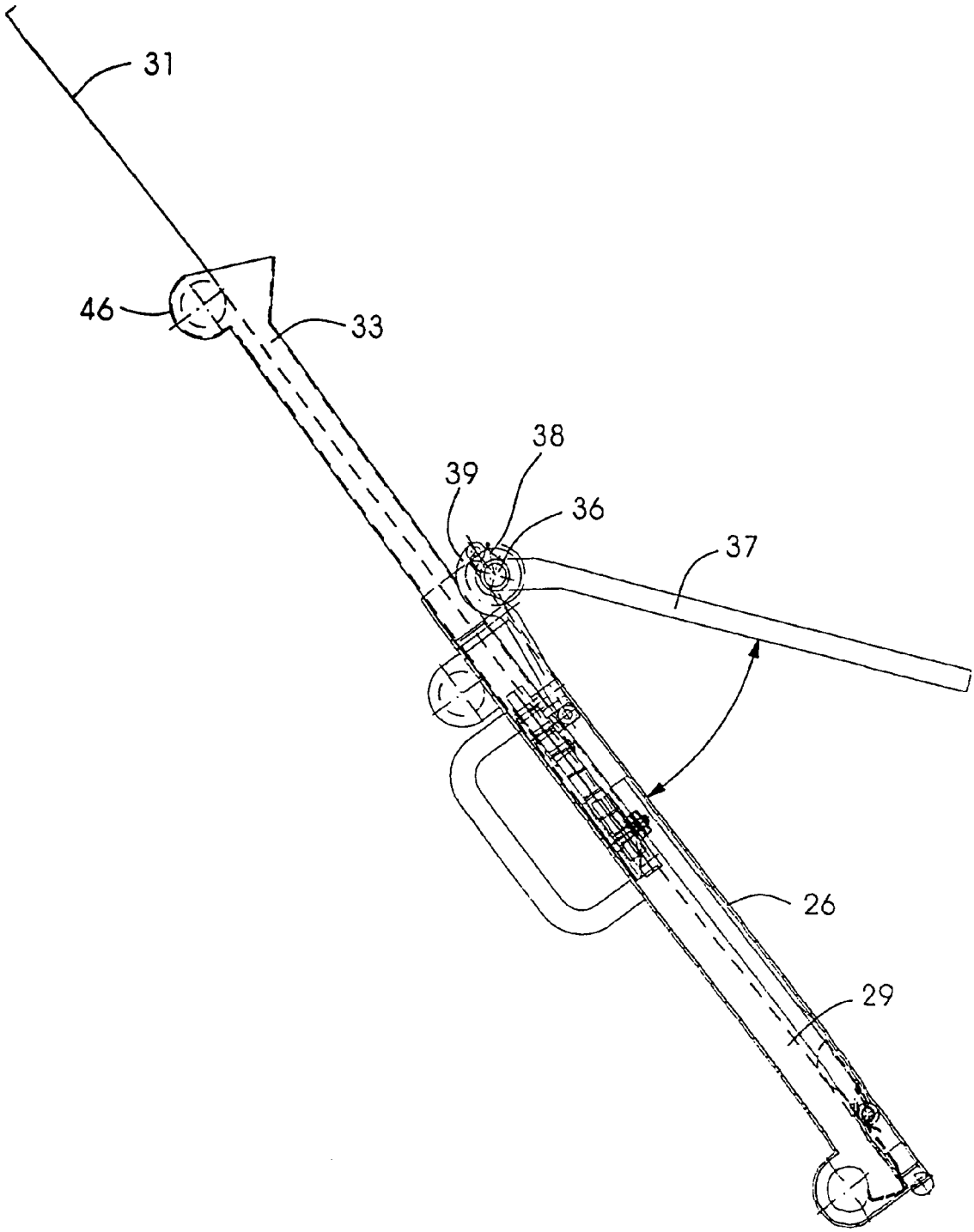
FIG. 5 is an enlarged, fragmentary, elevational view of FIG. 4, showing deflection equipment for the mechanical insertion and extraction mechanism in greater detail.

Due to the pivoting movement of the printing plate storage device 29 into the operating position C, the shaft 36 is pivoted. As is shown in FIG. 5, a crank 38 fixed to the shaft 36 so as to rotate therewith is articulatingly connected to one end of a couple 39. The other end of the couple 39 engages a part of the lazy tongs transmission or mechanism 34. The upper end of the lazy tongs mechanism 34, which is shown at the bottom of FIG. 4, is fixed to the guard 26, while the lower end is connected to the printing plate support 33. Due to the pivoting movement of the shaft 36, the crank 38 is deflected or swung outwardly and applies a pulling force to the couple 39, which results in the lazy tongs mechanism 34 being pushed together and the printing plate support 33 being extended. During a pivoting movement of the storage device/guard 29/26 back from the feed position C, the lazy tongs mechanism 34 is pulled apart and the printing plate support 33 is retracted. The left-hand side of FIG. 4 thus shows the printing plate support 33 in the retracted operating state. The right-hand side of FIG. 4 shows the printing plate support 33 in the extended operating state.

Figure 6:
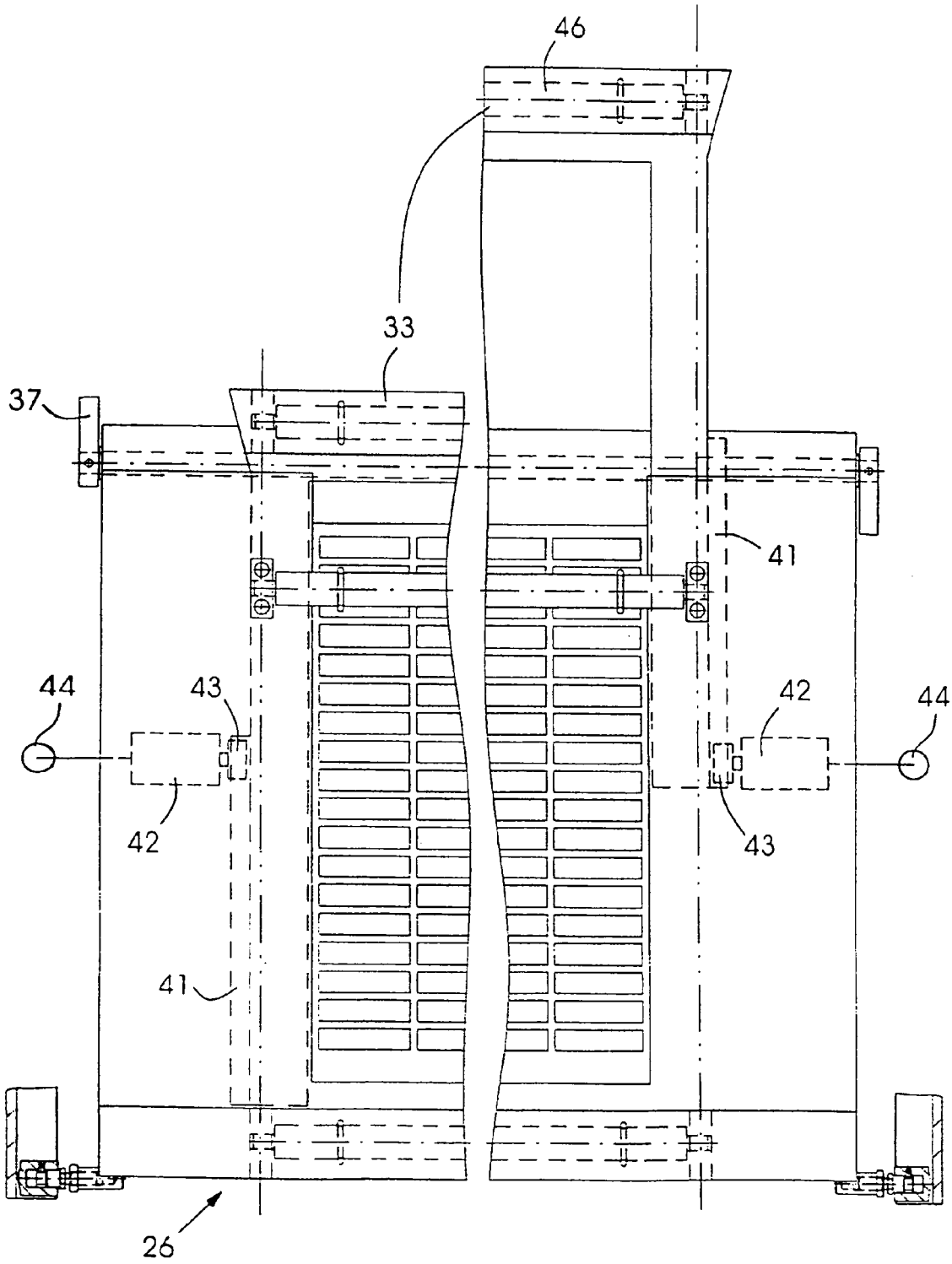
FIG. 6 is another view similar to that of FIG. 4 of a second exemplary embodiment of the insertion and extraction mechanism with an electromotive transmission system.

In a further exemplary embodiment according to FIG. 6, provision is made for the printing plate support 33 to be provided with a rack 41, wherein a pinion 43 driven by an actuating motor 42 engages. As a result of this feature, the printing plate support 33 can be extended and retracted by an electric motor. A switch or sensor 44 which is preferably provided, is actuated by the pivoting movement of the storage device/guard 26, as a result of which the printing plate support 33 is extended or retracted automatically under control. The left-hand side of FIG. 6 shows the printing plate support 33 in the retracted operating state. The right-hand side of FIG. 6 shows the printing plate support 33 in the extended operating state.

Figure 7:
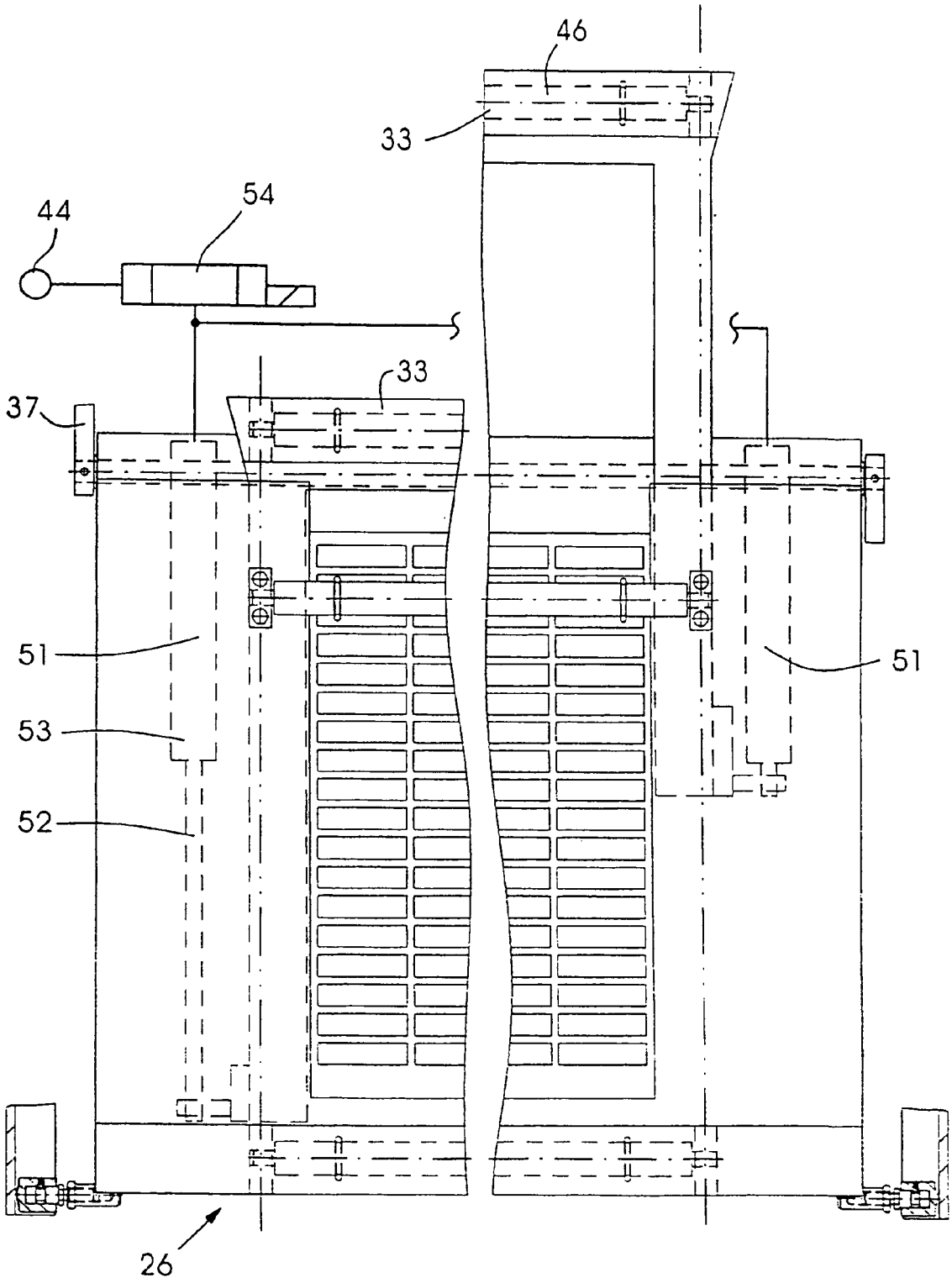
FIG. 7 is a further view similar to that of FIG. 4 of a third exemplary embodiment of the insertion and extraction mechanism with a pneumatic actuating system.

In a third exemplary embodiment of the invention illustrated in FIG. 7, provision is made for fixing an operating cylinder 51, for example a pneumatic cylinder, by a piston rod 52 to the printing plate support 33 and by a cylinder 53 to the printing plate storage device 29 or guard 26. Due to this feature, the printing plate support 33 is retractable and extensible by pneumatic actuation. The switching can be performed by conventional solenoid valves 54, which are driven by the switch or sensor 44. FIG. 7 shows, at the left-hand side thereof, the printing plate support 33 in the retracted operating state. The printing plate support 33 is shown in the extended operating state at the right-hand side of FIG. 7.

This application claims the priority, under 35 U.S.C. § 119, of German Patent Application 103 33 920.5, filed Jul. 2, 2003; the entire disclosure of the prior German application is herewith incorporated by reference.

We claim:

1. A device for at least one of feeding a plate to and removing a plate from a printing press, the device comprising:

a plate storage device for holding at least one of a new and a used plate, said plate storage device being pivotally mounted, and said plate storage device having a linearly movable plate support; and a mechanical deflection mechanism being mounted to said plate storage device and being pivotable by said plate storage device for effecting a linear movement of said plate support.

2. The device according to claim 1, including a mechanism for moving said plate support out of and into said plate storage device.

3. The device according to claim 2, wherein said mechanism is a lazy tongs mechanism.

4. The device according to claim 2, wherein said mechanism is a rack mechanism.

5. The device according to claim 4, wherein said rack mechanism includes a pinion driven by an actuating motor under sensor or switch control.

6. The device according to claim 1, further comprising an operating cylinder for linearly moving said plate support.

7. The device according to claim 6, including a solenoid valve controllable by a sensor or switch for activating said operating cylinder.

8. The device according to claim 1, including a rotabably mounted supporting roller provided at a free end of said plate support.

9. The device according to claim 1, including a spring-loaded latching and holding device for locking said plate storage device in a plate feed position.

* * * * *